US008549817B2

(12) United States Patent
Burke et al.

(10) Patent No.: US 8,549,817 B2
(45) Date of Patent: Oct. 8, 2013

(54) GLASS CLAMP

(75) Inventors: David J. Burke, Brick, NJ (US); Martin P. Burns, Forked River, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 2328 days.

(21) Appl. No.: 11/156,344

(22) Filed: Jun. 17, 2005

(65) Prior Publication Data

US 2006/0284522 A1 Dec. 21, 2006

(51) Int. Cl.
*E04B 1/61* (2006.01)
*E06B 3/54* (2006.01)
*E06B 1/38* (2006.01)

(52) U.S. Cl.
CPC ..... *E06B 3/5454* (2013.01); *E06B 1/38* (2013.01)
USPC ..... 52/770; 52/716.8

(58) Field of Classification Search
USPC ..... 52/208, 762, 764, 716.8, 770, 204.67, 52/204.72, 235; 256/24, 31; 277/651, 654, 277/644; 428/212
See application file for complete search history.

(56) References Cited

U.S. PATENT DOCUMENTS

| | | | | |
|---|---|---|---|---|
| 5,867,869 | A * | 2/1999 | Garrett et al. | 16/252 |
| 5,879,789 | A * | 3/1999 | Dolan et al. | 428/212 |
| 2006/0097237 | A1 * | 5/2006 | McGregor | 256/24 |
| 2007/0107351 | A1 * | 5/2007 | Garrett | 52/474 |

FOREIGN PATENT DOCUMENTS

| | | | |
|---|---|---|---|
| DE | 3531674 | A1 * | 3/1986 |
| DE | 20216351 | U1 * | 12/2002 |
| DE | 20311548 | U1 * | 1/2004 |
| DE | 202005009826 | U1 * | 11/2005 |

* cited by examiner

*Primary Examiner* — William Gilbert
(74) *Attorney, Agent, or Firm* — Francis C. Hand; Carella, Byrne, et al.

(57) ABSTRACT

Each mounting clamp of a lower most pair of mounting clamps for mounting a glass panel, includes a horizontal ledge for receiving the weight of the glass panel during assembly. After positioning of the glass panel on the horizontal ledges, the mounting clamps are tightened to clamp the glass panel in place.

14 Claims, 5 Drawing Sheets

GLASS CLAMP

This invention relates to a glass clamp. More particularly, this invention relates a glass clamp for mounting glass panels in place.

As is known, there are various types of clips and clamps for the mounting of glass panels particularly for food display units. For example, clamps have been made of two parts that may be secured together by screws in order to sandwich a glass panel between the two parts. Typically, rubber pads are disposed between the clamp parts and the glass panel in order to hold the glass panel in place without scratching or breaking of the glass panel. Generally, the glass clamps have been used in environments where a glass panel is to be mounted between two parallel supports. In these cases, two pairs of clamps are first secured to the supports prior to mounting of the glass panel between the clamps with the two parts of each clamp in a loosened condition so that a glass panel can be slid between the pairs of clamps. However, this presents a problem of holding the glass panel in the proper position while the two parts of each clamp are tightened in holding engagement with the glass panel. In order to solve this problem, installation of a glass panel frequently requires two persons, one to hold the panel and one to tighten the clamps.

Accordingly, it is an object of the invention to be able to position a glass panel in proper position between two supports prior to securing the panel in place by the means of clamps.

It is another object of the invention to facilitate the mounting of a glass panel between a pair of supports in a safe manner.

It is another object of the invention to allow one person to mount a glass panel between a pair of vertical supports.

It is another object of the invention to be able to install glass panels in a frame in a manner that reduces the risk of injury to the installer.

Briefly, the invention provides a glass clamp for a glass panel wherein the clip includes a pair of plates that define a gap for receiving a glass panel in a vertical or inclined disposition with at least one of the plates having a horizontal ledge for receiving a bottom edge of the glass panel thereon.

In accordance with the invention, a pair of the glass clamps is first mounted on a pair of parallel supports in opposed facing relation with a pair of conventional clamps secured to the supports at a higher level. With the four clamps in an opened or loosened condition, a glass panel is slid between the plates of the upper pair of clamps and then the plates of the lower pair of clamps as is conventional. The glass panel is then positioned to rest on the horizontal ledge of each mounting clamp of the lower pair of clamps.

While the glass panel is supported on the two lower mounting clamps, each of the four mounting clamps may then be tightened in order to secure the glass panel in place in a secure manner. The ledges of the lower pair of clamps allows the installer to manipulate the closing of the clamps in a hands-free manner. That is, there is no further need to hold the glass panel manually as the panel is supported from below by the ledges and to the sides by the clamps.

These and other objects and advantages of the invention will become more apparent from the following detailed description taken in conjunction with the accompanying drawings wherein.

Figure 1:
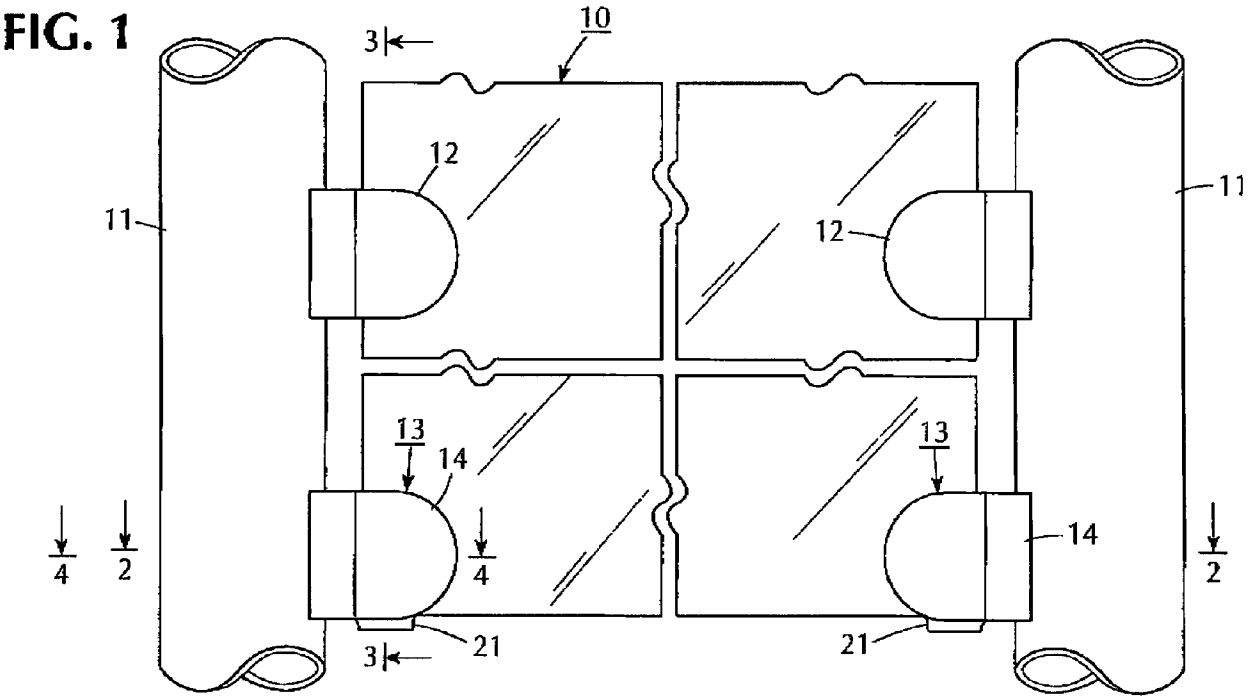
FIG. 1 illustrates a glass panel mounted between a pair of vertical supports and held in place by mounting clamps constructed in accordance with the invention.

Referring to FIG. 1, a glass panel 10 is disposed between a pair of parallel supports 11 and is mounted in place by an upper pair of mounting clamps 12 of conventional structure and a lower pair of mounting clamps 13 constructed in accordance with the invention.

The glass panel 10 is made of any suitable size, shape and thickness as is conventional.

The supports 11 may be of tubular construction, as illustrated or may be of other suitable shapes, such as a rectangular or polygonal cross-sectional shape. In addition, the supports 11 are disposed vertically although the supports 11 may also be disposed at an angle to a vertical plane.

Figure 2:
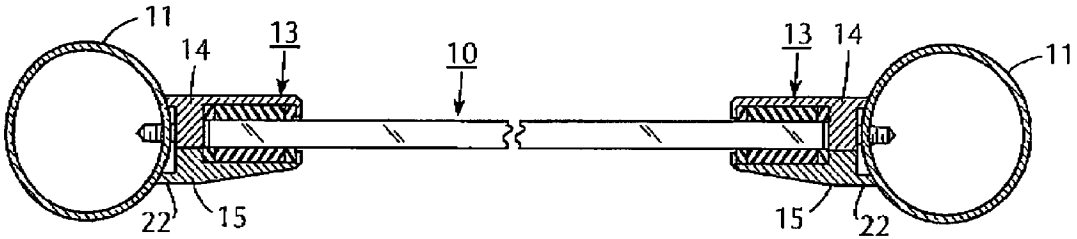
FIG. 2 illustrates a view taken on line 2-2 of FIG. 1.
Figure 4:
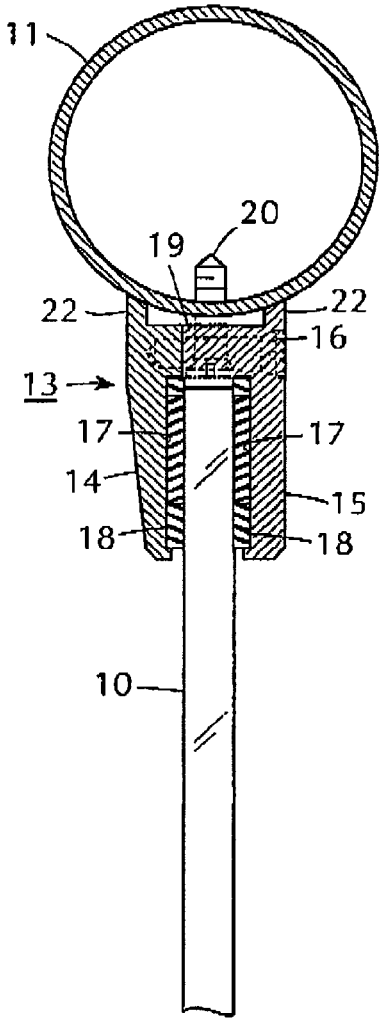
FIG. 4 illustrates a view taken on line 4-4 of FIG. 1.
Figure 5:
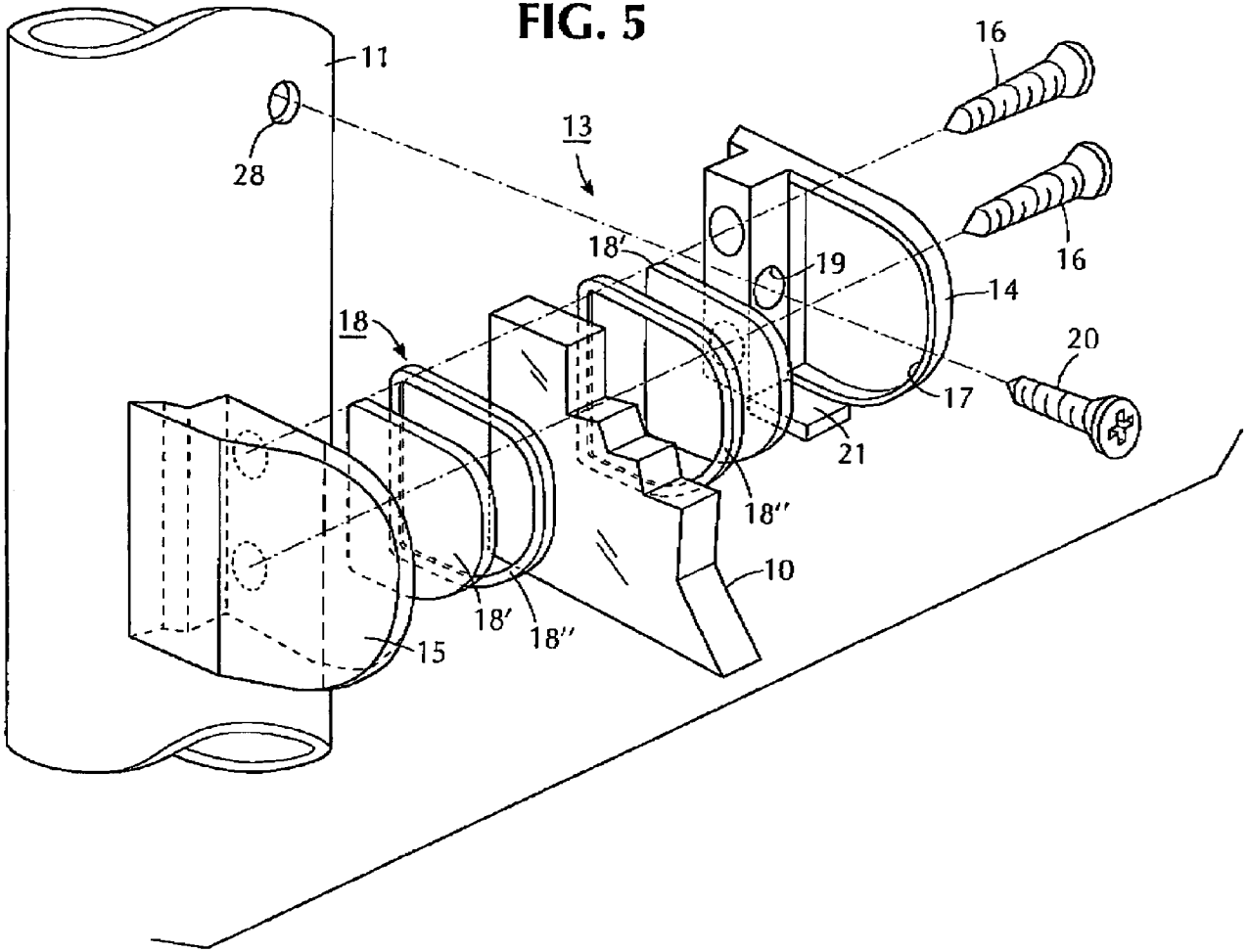
FIG. 5 illustrates an exploded view of a glass clamp in accordance with the invention.

Referring to FIGS. 2 and 5, each mounting clamp 13 is constructed of a pair of one-piece plates 14, 15 that define a vertically disposed gap for receiving the glass panel 10 therebetween. As illustrated in FIGS. 4 and 5, the plates 14, 15 are secured together by a means, such as a pair of screws 16, that pass through one plate 14 into threaded engagement with the opposite plate 15.

Each plate 14, 15 is also provided with a recess 17 to receive a rubber gasket or ring 18 for resiliently engaging the glass panel 10. The gaskets 18 which are used may be a 3/16 inch solid black Santoprene, a ¼ inch closed cell foam, or the like. Typically, one set of gaskets 18 will accommodate all thicknesses of glass.

Referring to FIG. 5, each gasket 18 is shaped to fit into the recess of the plate 14 and has a flat end and an opposite rounded end. The gasket 18 also has a central section 18' of similar shape that is of reduced thickness and that can be popped out from the periphery 18" of the gasket where not required for compression purposes and suitably discarded. When in place, the outer periphery 18" of the gasket 18 is compressed when the plates 14, 15 are brought together against the glass panel 10.

If additional compression is required to hold, for example, a thinner glass panel in place, the central section 18' of the gasket 18 remains in place.

Referring to FIG. 4, the larger plate 14 of a mounting clamp 13 is also provided with a passage 19 through which a threaded screw 20 is passed into threaded engagement with the support 11 in order to secure the clamp 13 to the support 11.

Figure 3:
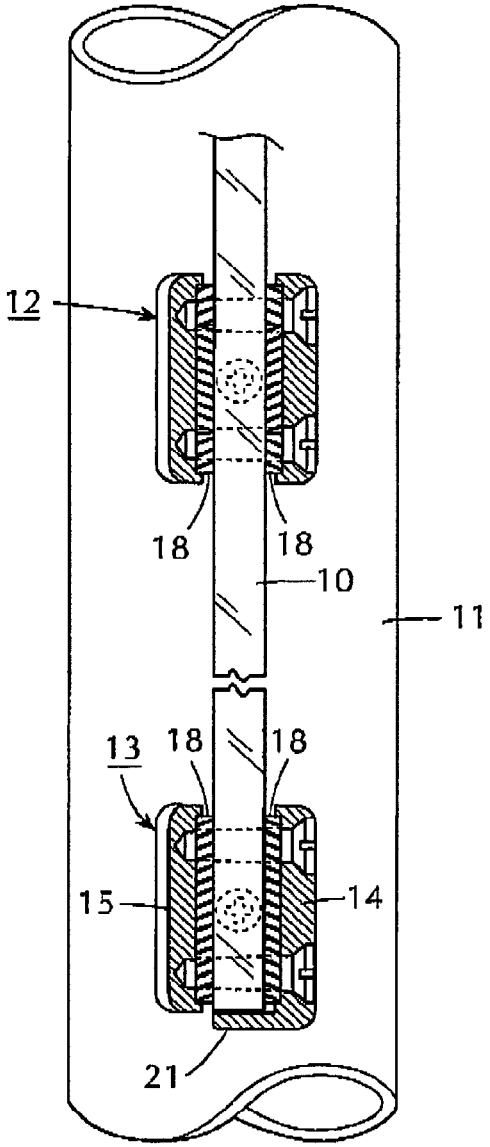
FIG. 3 illustrates a view taken on line 3-3 of FIG. 1.

Referring to FIGS. 3 and 5, the larger plate 14 is also provided with a horizontal ledge 21 for receiving the vertically disposed glass panel 10 thereon.

As shown in FIGS. 1 and 3, the ledge 21 is disposed along and under a bottom edge of the plate 14 and has a rounded edge (not shown) at one end thereof. In the illustrated embodiment, the ledge 21 extends along a minor fraction of the horizontal length of the plate 14.

As shown in FIG. 1, the ledge 21 on the larger plate 14 illustrated in the left side of the view extends along the underside of this plate 14

The upper mounting clamps 12 are of similar construction as the lower clamps 13 but do not include the horizontal ledge 21.

In order to mount the glass panel 10 between the supports 11, the two pairs of mounting clamps 12,13 are secured in place to the respective supports 11 via the screws 20. Prior to clamping of the respective plates of each clip together, the glass panel 10 is slid through the upper pair of clamps onto the ledges 21 of the lower pair of clamps 13. With the panel 10 thus resting on the ledges 21, the screws 16 of each mounting clip 12,13 are then tightened so that the glass panel 10 is securely clamped between the gasket 18 and plates of each clamp 12,13.

Referring to FIGS. 2 and 4, each plate 14,15 of each mounting clamp 12, 13 is provided with a vertical flange 22 with a rounded back surface contoured to the rounded shape of the support 11 in order to allow the clamps 12,13 to mate against the tubular support 11 when secured in place.

Figure 6:
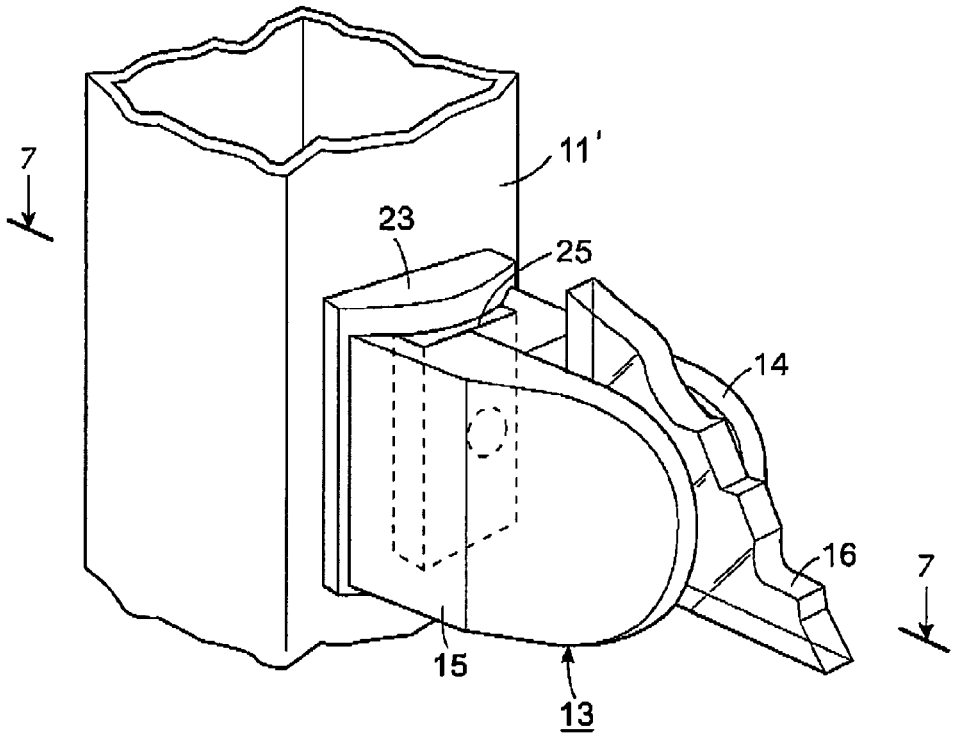
FIG. 6 illustrates a perspective view of a glass clamp with an adapter for use of a glass clamp with a rectangular support.
Figure 7:
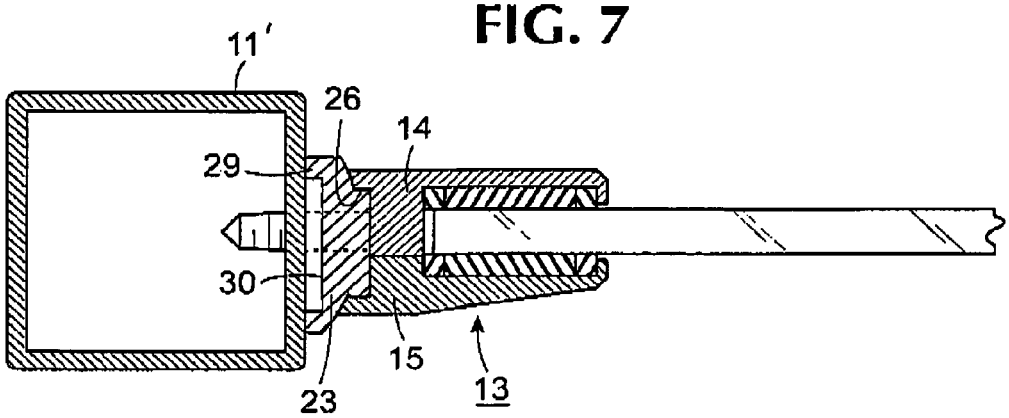
FIG. 7 illustrates a view taken on line 7-7 of FIG. 6.
Figure 8:
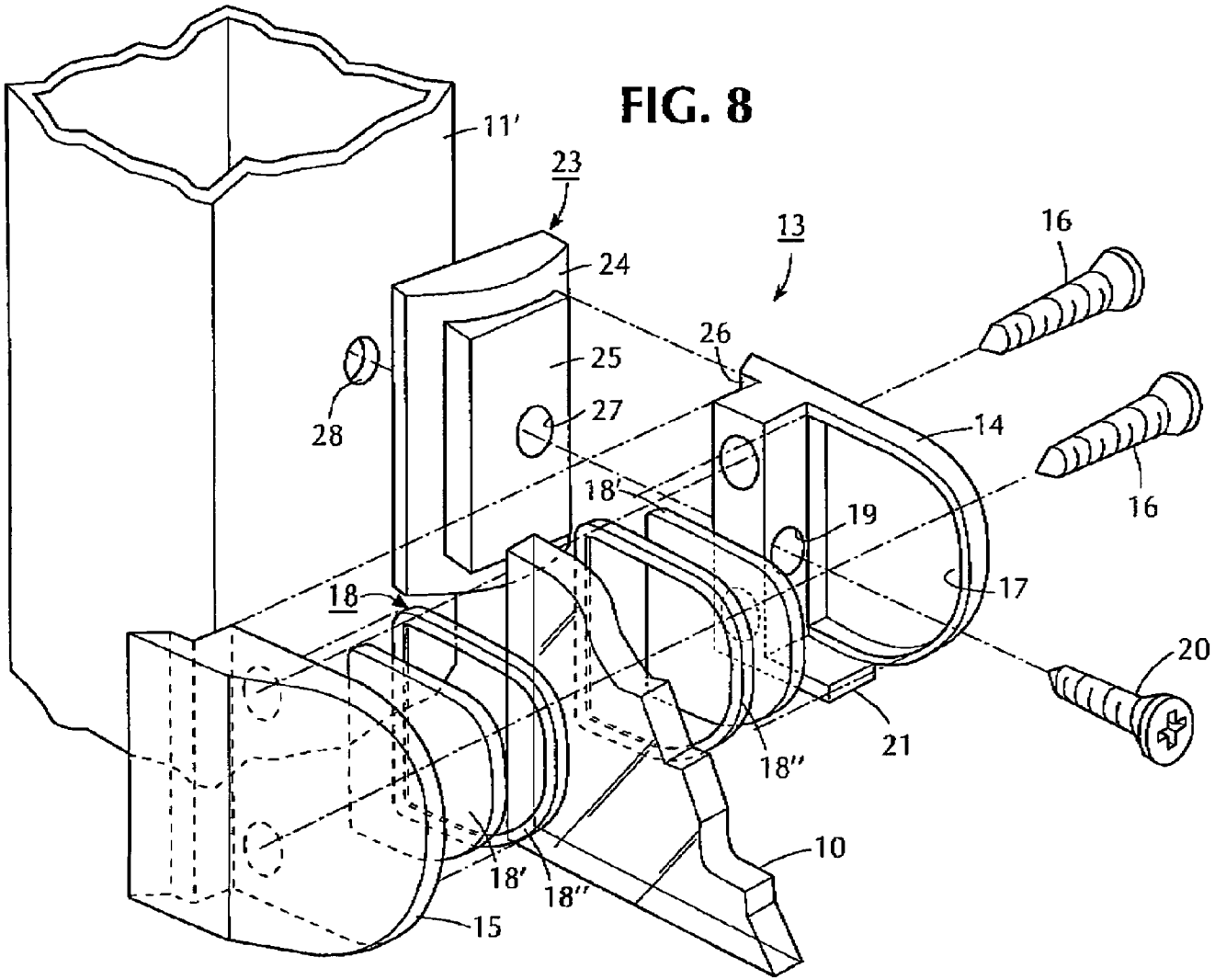
FIG. 8 illustrates an exploded view of the glass clamp of FIG. 6.

Referring to FIGS. 6 to 8, wherein like reference characters indicate like parts as above, an adapter 23 is provided to allow the mounting clamp 13 to be secured to a support 11' of rectangular shape.

As illustrated in FIG. 8, the adapter 23 has a generally cylindrical surface 24 against which the back side of the mounting clamp 13 abuts in mated relation. In addition, the adapter 23 has a raised rectangular portion 25 that fits in a recessed manner within a recess 26 on a back side of the mounting clamp 13.

The adapter 23 also has a bore 27 that is aligned with the passage 19 in the plate 14 of the mounting clamp 13 for passage of the threaded screw 20 therethrough into an aperture 28 in the support 11'.

The adapter 23 has a peripheral flange 29 (see FIG. 7) on the back side to define a recess 30 and to abut against a flat surface of the support 11'.

The adapter 23 may be made of any suitable material, such as an acetal plastic material, to avoid scratching of the support 11'.

The clamps are sized to accommodate glass thicknesses, for example, from 6 millimeters to ¼ inch and more and are within industry standards for thickness tolerances. The ledges 21 are of such dimensions lengthwise and thickness wise to readily support the weight of the glass panels.

The invention thus provides a simple means of holding the weight of a glass panel during assembly, particularly in a food display unit.

The invention also allows installation of a glass panel, for example, in a food display unit by one person only with a reduced risk of injury to the person.

What is claimed is:

1. A mounting clamp for a glass panel, said clamp including a pair of plates defining a gap for receiving a glass panel therebetween, a ledge extending only along a minor fraction of the horizontal length of one of said pair of plates for receiving a bottom edge of the glass panel thereon, said one plate being disposed in a vertical plane and said ledge being disposed along a bottom edge of said one plate and below said one plate; and means for securing said plates together to sandwich the glass panel therebetween.

2. A mounting clamp as set forth in claim 1 wherein each said plate has a flange with a rounded backside to abut a cylindrical surface of a vertical support.

3. A mounting clamp as set forth in claim 2 further comprising an adapter having a cylindrical surface abutting each said flange of each said plate and having at least a flat peripheral surface on a backside to abut a flat surface of a vertical support.

4. A mounting clamp as set forth in claim 1 further comprising at least one gasket disposed in each of said plates for abutting a glass panel in compressed relation.

5. A mounting clamp as set forth in claim 1 further comprising a pair of gaskets disposed in each of said plates for abutting a glass panel in compressed relation, one of said pair of gaskets being fitted into the other of said pair of gaskets to stiffen said one gasket.

6. A mounting arrangement for a glass panel, said mounting arrangement comprising a pair of plates defining a vertically disposed gap for receiving a vertically disposed glass panel therebetween, each said plate having a vertically disposed flange with a rounded backside to abut a cylindrical surface of a vertical support;

a horizontal ledge on at least one of said plates and extending only along a minor fraction of the horizontal length of said one plate for receiving the vertically disposed glass panel thereon;

at least a pair of resilient members disposed between said plates for resiliently engaging a glass panel therebetween; and means securing said plates together and resiliently compressing said resilient members against a glass panel therebetween.

7. A mounting arrangement as set forth in claim 6 wherein said ledge is disposed along and below a bottom edge of said one plate.

8. A mounting clamp as set forth in claim 6 further comprising an adapter having a cylindrical surface abutting each said flange of each said plate and having at least a flat peripheral surface on a backside to abut a flat surface of a vertical support.

9. In combination a pair of supports disposed in horizontally spaced apart parallel relation;

a glass panel disposed between said supports;

a first pair of mounting clamps, each said mounting clamp being secured to a respective support and including a pair of plates receiving said glass panel therebetween, a ledge on an underside of one of said plates receiving a bottom edge of said glass panel thereon, said ledge extending along a minor fraction of the horizontal length of said one plate; and a second pair of mounting clamps, each said mounting clamp of said second pair of mounting clamps being secured to a respective support and including a pair of plates receiving said glass panel therebetween.

10. The combination as set forth in claim 9 wherein each said support is vertically disposed.

11. The combination as set forth in claim 10 wherein said ledge is horizontally disposed.

12. The combination as set forth in claim 9 wherein each said plate has a flange with a rounded backside to abut a cylindrical surface of a respective one of said supports.

13. The combination as set forth in claim 12 further comprising an adapter having a cylindrical surface abutting each said flange of each said plate and having at least a flat peripheral surface on a backside to abut a flat surface of a respective one of said supports.

14. The combination as set forth in claim 9 further comprising a gasket disposed in each of said plates for abutting said glass panel in compressed relation, each said gasket having a removable central section.

* * * * *